US007472570B2

(12) United States Patent
Yamaguchi et al.

(10) Patent No.: US 7,472,570 B2
(45) Date of Patent: Jan. 6, 2009

(54) KEY CYLINDER

(75) Inventors: Jun Yamaguchi, Aichi-ken (JP); Toshiharu Katagiri, Aichi-ken (JP)

(73) Assignee: Kabushiki Kaisha Tokai-Rika-Denki-Seisakusho, Aichi-ken (JP)

( * ) Notice: Subject to any disclaimer, the term of this patent is extended or adjusted under 35 U.S.C. 154(b) by 60 days.

(21) Appl. No.: 11/696,634

(22) Filed: Apr. 4, 2007

(65) Prior Publication Data

US 2007/0234768 A1 Oct. 11, 2007

(30) Foreign Application Priority Data

Apr. 10, 2006 (JP) ..... 2006-107649

(51) Int. Cl.
*E05B 17/04* (2006.01)

(52) U.S. Cl. ..... 70/379 R; 70/492; 70/495; 70/496

(58) Field of Classification Search ..... 70/379 R, 70/380, 495, 496, 422, 492
See application file for complete search history.

(56) References Cited

U.S. PATENT DOCUMENTS 3,410,123 A * 11/1968 Jacobi ..... 70/495
5,577,409 A * 11/1996 Oyabu et al. ..... 70/379 R
5,765,417 A * 6/1998 Bolton ..... 70/495
6,439,016 B1 * 8/2002 Wittwer et al. ..... 70/379 R
6,523,382 B1 * 2/2003 Dimig et al. ..... 70/496
6,711,924 B2 * 3/2004 Ritz ..... 70/422
6,968,717 B2 * 11/2005 Suzuki et al. ..... 70/492
6,978,645 B2 * 12/2005 Shimon ..... 70/379 R
2003/0089149 A1 * 5/2003 Suzuki et al. ..... 70/492
2004/0255627 A1 * 12/2004 Shimon ..... 70/379 R
2007/0084259 A1 * 4/2007 Bellamy et al. ..... 70/278.7

FOREIGN PATENT DOCUMENTS

JP 7-150830 A 6/1995

* cited by examiner

*Primary Examiner*—Suzanne D Barrett
(74) *Attorney, Agent, or Firm*—Roberts Mlotkowski Safran & Cole, P.C.; Thomas W. Cole

(57) ABSTRACT

In a key cylinder a stopper plate is pressed into an imposing hole of a rotor, latching to a body and also intruding into engagement grooves of a second sleeve. When an authentic key is inserted into the rotor and rotated, a first sleeve is not rotated, and a second sleeve is rotated through the stopper plate. When a false key is inserted into the rotor the first sleeve rotates and the second sleeve is slid to the rear by slide bars, therefore the stopper plate separates from the engagement grooves, and the second sleeve is not rotated. The stopper plate has the function of being able to stop the movement of the rotor in the forward-rearward direction, and also the function of making the second sleeve rotatable by the rotation of the rotor, and so the construction of the key cylinder is simplified.

10 Claims, 4 Drawing Sheets

KEY CYLINDER

CROSS-REFERENCE TO RELATED APPLICATIONS

This application is based on and claims priority under 35 USC 119 from Japanese Patent Application No. 2006-107649 filed on Apr. 10, 2006.

BACKGROUND

1. Field of the Invention

The present invention relates to a key cylinder that operates an engaging member when a key is inserted into a rotor and rotated.

2. Description of the Related Art

Key cylinders having a main rotor accommodated in a cylindrical holder, and a rear rotor are known in the art. In one such key cylinder, the rear rotor is assembled to the main rotor by a pull-out preventing component of a ring cap that is engaged with the cylindrical holder. The main holder, rear rotor and ring cap are assembled to the cylindrical holder. Movement of the main rotor forward (in the key extraction direction) is stopped by a guard portion of the cylindrical holder. Movement of the main holder rearward (in the key insertion direction) is stopped by the ring cap through the rear rotor (see Japanese Patent Application Laid-Open (JP-A) No. 7-150830).

In such a key cylinder, when a key (authentic key) is inserted into the main rotor, left and right levers provided on the main rotor are able to latch to the rear rotor. Therefore, when the key is rotationally operated, the main rotor is rotated, and the rear rotor is rotated.

When an insertion member that is not the authentic key (an incorrect key etc.) is inserted into the main rotor, the left and right levers provided on the main rotor are not able to latch to the rear rotor. Due to this, even if the insertion member is rotationally operated, even though the main rotor is rotated, the rear rotor is not rotated.

However, in such a key cylinder, there are separate parts for the ring cap having the function of being able to stop movement of the main rotor in the forward direction and in the rearward direction, and for the left and right levers having the function of being able to make the rear rotor rotatable with the rotation of the main rotor.

SUMMARY OF THE INVENTION

The present invention is made in the light of the above circumstances and has an object of obtaining simplification in the construction of a key cylinder.

A first aspect of the invention is to provide a key cylinder including: a rotor, rotating by a key being inserted therein and rotationally operated; an accommodating member accommodating the rotor; a latching member provided at the rotor and stopping movement of the rotor in at least one of a direction of insertion of the key, or a direction of extraction of the key, by latching at the accommodating member; and an engaging member which, when the key is inserted into the rotor and the rotor has been rotated, by engaging with the latching member, is operated by rotation of the rotor, and which, when the key is not inserted into the rotor and the rotor has been rotated, does not engage with the latching member and is not operated by the rotation of the rotor.

A second aspect of the present invention is a key cylinder of the first aspect, wherein the rotor may be assembled by inserting it into the accommodating member in the key extraction direction.

In the key cylinder of the first aspect of the present invention the rotor is accommodated in the accommodating member, and by latching the latching member provided on the rotor to the accommodating member, movement of the rotor in at least one of the key insertion direction or the key extraction direction is stopped.

When the rotor is rotated by the key being inserted into the rotor and rotationally operated, the engagement member is operated by the rotation of the rotor by the engagement of the latching member to the engagement member. However, when the key is not inserted into the rotor but the rotor is rotated, the latching member is not engaged with the engaging member and the engaging member is not operated by the rotation of the rotor.

Here, the latching member does not only have the function of being able to stop movement of the rotor in at least one of the key insertion direction or the key extraction direction. The latching member also has the function of making the engaging member operable by the rotation of the rotor. Therefore, the construction of the key cylinder is simplified.

In the key cylinder according to the second aspect of the present invention, the rotor may be assembled by insertion into the accommodating member in the key extraction direction. Due to this, the latching member for stopping movement of the rotor in the key extraction direction may be provided integrally to the accommodating member, and it may be made difficult to take the rotor out from the accommodating member in the key extraction direction.

BRIEF DESCRIPTION OF THE DRAWINGS

Exemplary embodiments of the present invention will be described in detail based on the following figures, wherein.

BRIEF DESCRIPTION OF THE INVENTION

Figure 1:
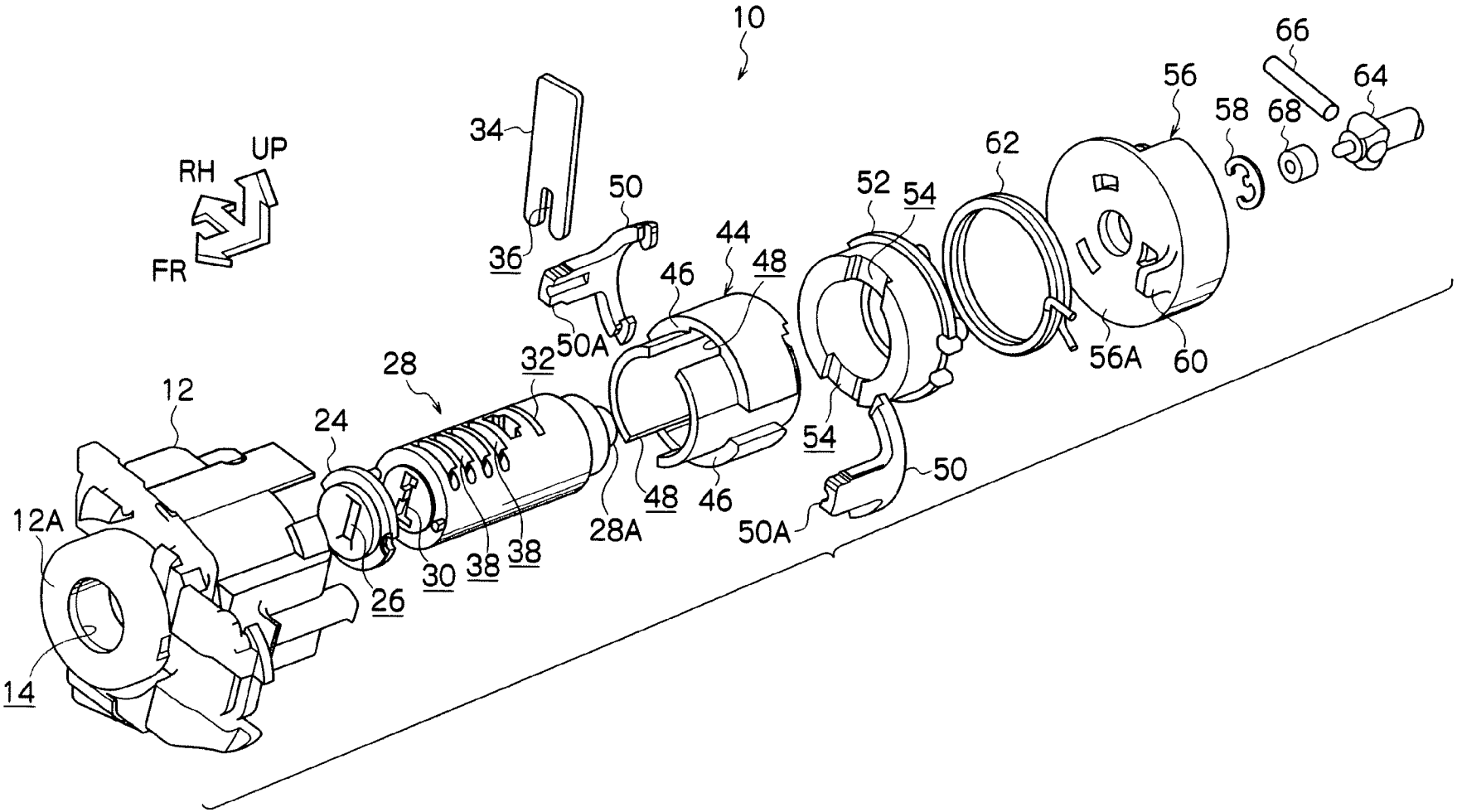
FIG. 1 is an exploded perspective diagram of a key cylinder according to an exemplary embodiment of the present invention, as viewed diagonally from the left forward direction.

A so-called freewheel type key cylinder 10 according to an exemplary embodiment of the present invention is shown in FIG. 1, as viewed from the left forward direction. In the figure the forward direction of the key cylinder 10 (the direction of key withdrawal, car exterior direction) is shown by the arrow FR, the top direction of the key cylinder 10 is shown by the arrow UP, and the right direction of the key cylinder 10 is shown by the arrow RH.

The key cylinder 10 according to the exemplary embodiment of the present invention is, for example, provided on a vehicle door (including the side doors and trunk door), with the forward direction of the key cylinder 10 to the vehicle exterior direction, with the front face thereof exposed to the exterior of the vehicle.

The key cylinder 10 is provided with a substantially circular cylindrical shaped body 12 (rotor case), serving as an accommodating member. Integrally provided on the body 12 is a front face portion 12A serving as a latch portion, the front face portion 12A having an aperture 14 formed at a central portion thereof, such that the central portion (other than the peripheral portion) of the body 12 is open in the forward direction.

Figure 2:
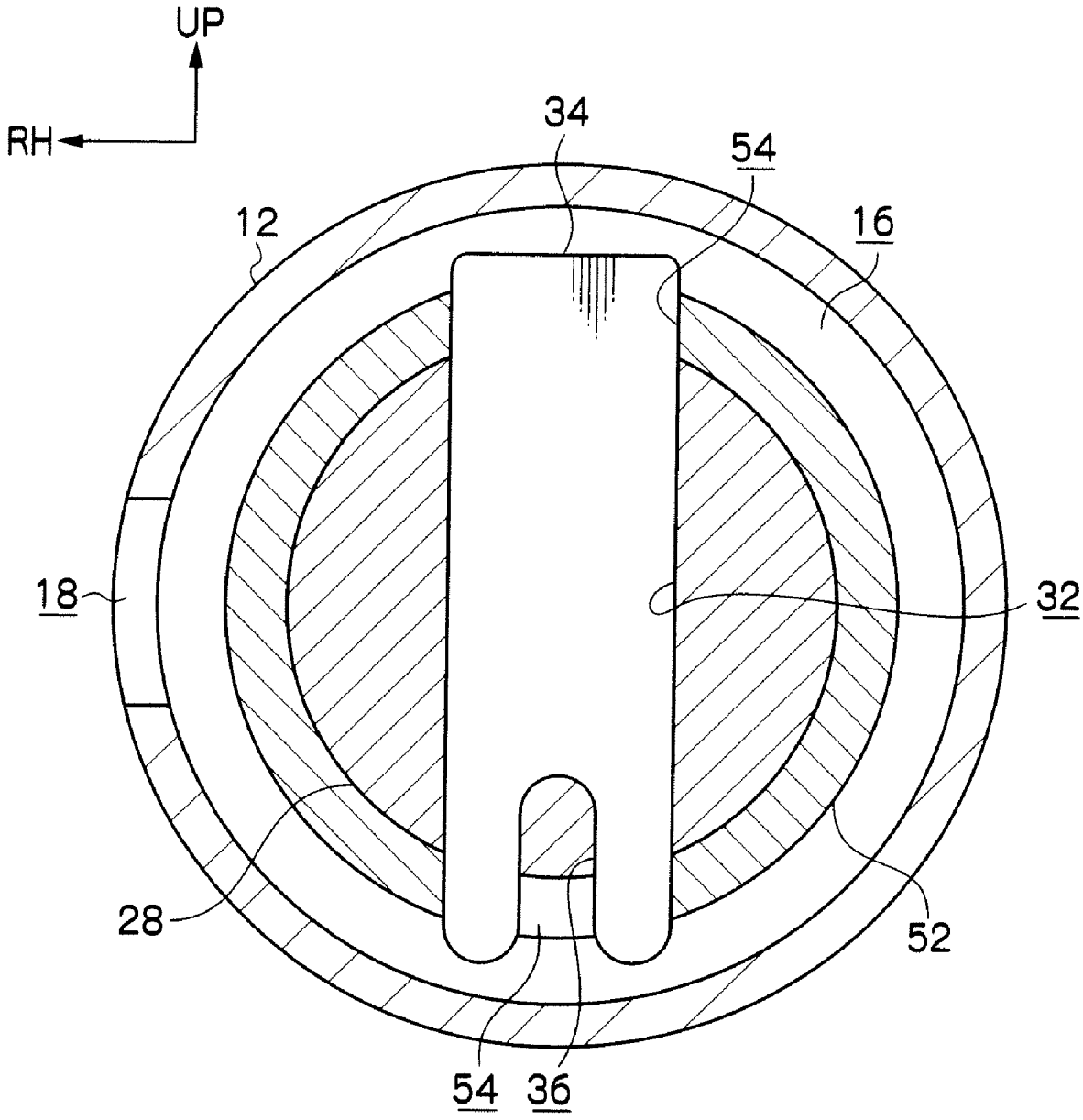
FIG. 2 is a cross-section showing a portion where a stopper plate is disposed of a key cylinder according to an exemplary embodiment of the present invention, as seen from the front.

As is shown in detail in FIG. 2, the peripheral face of the body 12 has a latch groove 16 that is a recess, rectangular in longitudinal cross-section, serving as a latch portion, and the latch groove 16 is disposed around the complete circumference at the inner peripheral face of the body 12. The right side wall of the body 12 has a rectangular insertion hole 18 formed therein, and the insertion hole 18 communicates with the latch groove 16.

Figure 4:
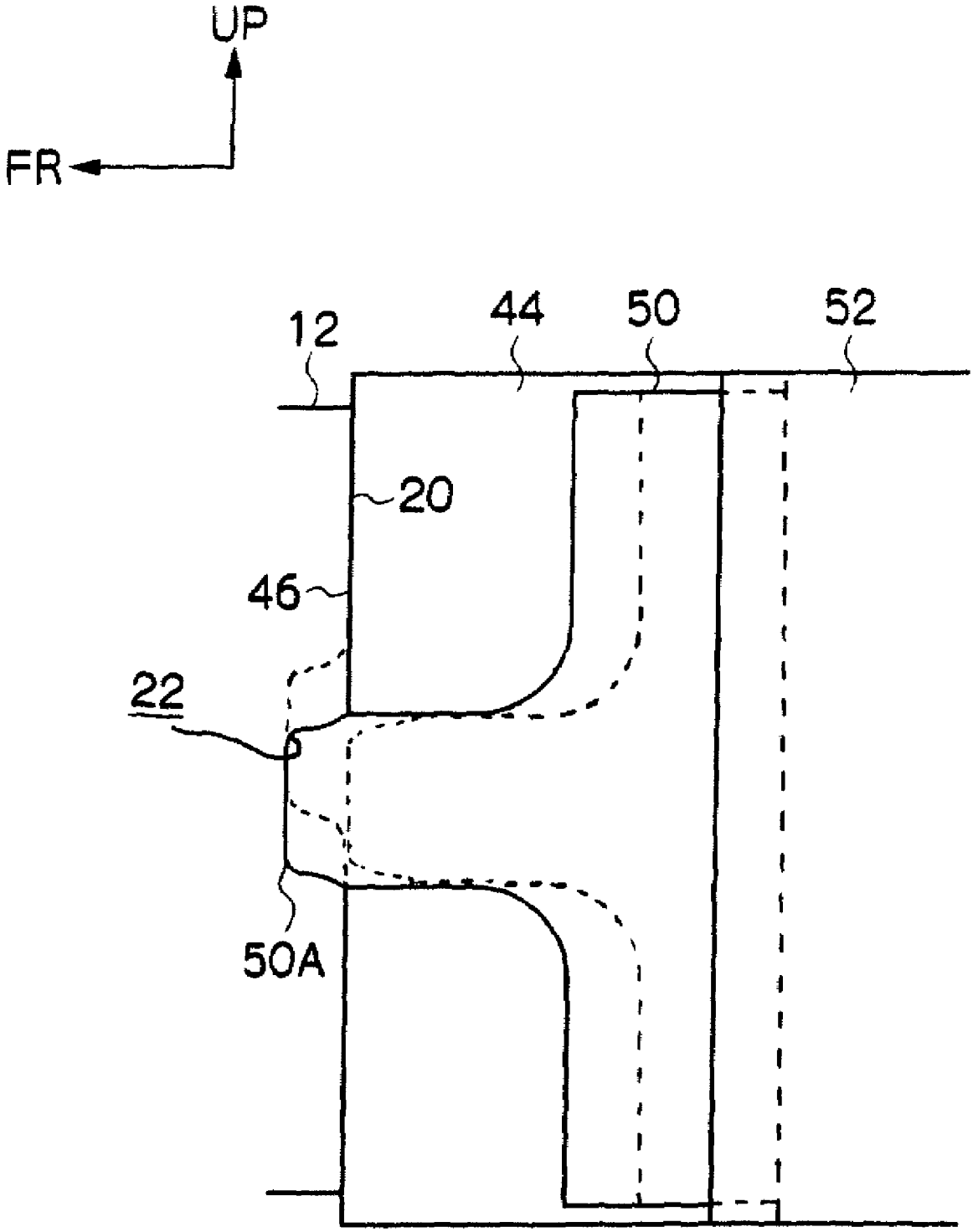
FIG. 4 is a lateral view from the left of the inside of a portion where a first sleeve (including one of the slidebars) is disposed inside a body of a key cylinder according to an exemplary embodiment of the present invention, wherein the rearward movement of the slidebars via a cam action is illustrated in phantom.

As is shown in detail in FIG. 4, there is an internal step portion 20 formed around in the circumferential direction at the front of the latch groove 16, and the inner peripheral face of the body 12 is larger in diameter at the rear side portion of the internal step portion 20 than at the front side portion of the internal step portion 20. There are engagement recesses 22 that are substantially rectangular in cross-section formed at a right portion and a left portion directly in front of the internal step portion 20, and the engagement recesses 22 are in communication with the rear side portion of the internal step portion 20, and all of the angular portions of the engagement recesses 22 are rounded off.

A block 24, serving as a projecting member, is of a substantially circular plate form accommodated in the body 12, and as a whole the peripheral portion of the block 24 is in a state of being captured against movement in the forward direction by the front face portion 12A of the body 12 and is rotatable. A central portion of the block 24 has a rectangular key insertion hole 26 formed therein and the key insertion hole 26 is exposed to the front through the aperture 14 of the front face portion 12A of the body 12.

A substantially cylindrical rod shaped rotor 28 is accommodated in the body 12 at the rearward direction of the block 24 (the direction of key insertion, vehicle interior direction), and the rotor 28 is engaged to the block 24 at the front face thereof, and is able to rotate integrally with the block 24. A key insertion hole 30 that has a substantially rectangular cross-section is formed at an axial central portion of the rotor 28, and the key insertion hole 30 communicates with the key insertion hole 26 of the block 24.

As is shown in detail in FIG. 2, there is an imposing hole 32 that is substantially rectangular in cross-section formed at a rear portion of the rotor 28 so as to pierce through the rotor 28 in the up-down direction. At one end of the imposing hole 32, corresponding to the rotational position of the rotor 28 that faces the insertion hole 18 of the body 12, a substantially rectangular stopper plate 34, serving as a latching member, is pushed in (inserted), and thereby the stopper plate 34 is imposed into the rotor 28. A substantially rectangular through hole 36 is formed at one end portion of the stopper plate 34, and the through hole 36 is open from one end of the stopper plate 34, so as to make it easy to push the stopper plate 34 into the imposing hole 32 from one end of the stopper plate 34. The stopper plate 34 protrudes out from the rotor 28 at each of the two ends in the up-down direction, and is inserted into the annular latch groove 16 of the body 12. By so doing, forward movement of the rotor 28 is prevented by engagement of the stopper plate 34 with the front face of the latch groove 16, and rearward movement of the rotor 28 is prevented by engagement of the stopper plate 34 with the back face of the latch groove 16, stopping the rotor 28 from coming out of the body 12.

Figure 3:
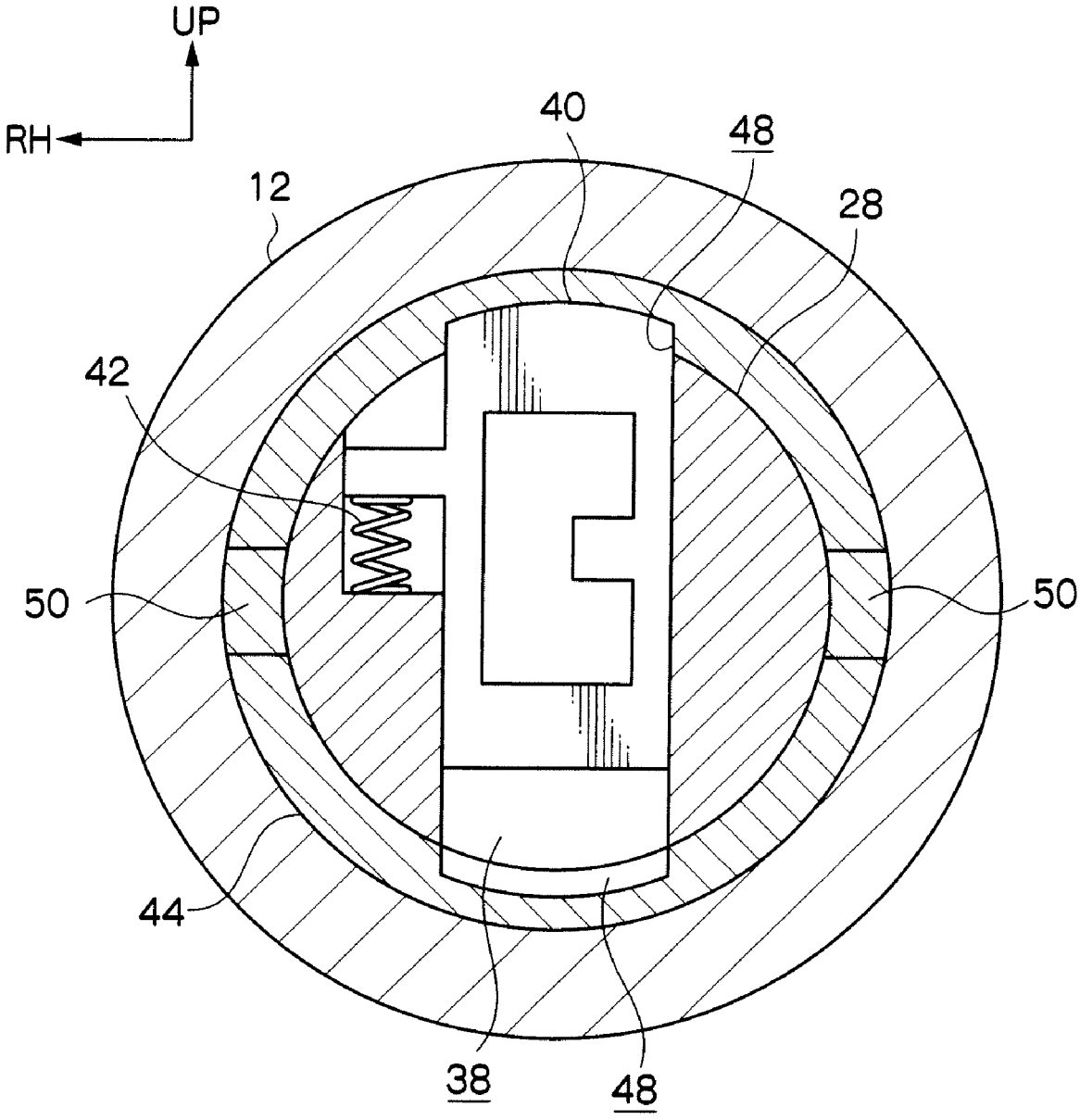
FIG. 3 is a cross-section showing a tumbler arrangement portion of a key cylinder according to an exemplary embodiment of the present invention, as seen from the front.

As is shown in detail in FIG. 3, there are plural, substantially rectangular in cross-section, placement holes 38, formed in the forward-rearward direction in front of the imposing hole 32 on the rotor 28, and the placement holes 38 pierce through the rotor 28 in the up-down direction. Disposed inside the placement holes 38 are substantially rectangular frame shaped tumblers 40 (lock plates) configuring a changeover unit, and the tumblers 40 are slidable (moveable) along the placement holes 38. As biasing members, there are coil springs 42 spanning between the tumblers 40 and the rotor 28 (inside the placement holes 38), and tumblers 40 protrude out of the rotor 28. In this way, when an authentic key (omitted from the drawings) is inserted as a key into the key insertion hole 30 of the rotor 28 from the key insertion hole 26 of the block 24, the tumblers 40 are slid in the rotor 28 by the key groove of the authentic key, overcoming the biasing force of the coil springs 42, and the protruding of the tumblers 40 from the rotor 28 is eliminated. On the other hand, when an insertion member other than the authentic key (such as an incorrect key) is inserted into the key insertion hole 30 of the rotor 28 from the key insertion hole 26 of the block 24, the tumblers 40 are not slid in the rotor 28, and the protruding of the tumblers 40 from the rotor 28 is maintained.

There is a small diameter portion 28A formed at the rear end of the rotor 28 in a substantially cylindrical rod shape, and the small diameter portion 28A has a diameter that is smaller than other portions of the rotor 28.

There is a substantially cylindrical first sleeve 44, rotatably accommodated in the body 12 and configuring the changeover unit, and the rotor 28 is rotatably accommodated inside the first sleeve 44. The stopper plate 34 is disposed to the rear of the first sleeve 44. There is an external step portion 46 formed around the circumference of the external periphery of the first sleeve 44, and the portion of the first sleeve 44 behind the external step portion 46 has a larger diameter than the portion in front of the external step portion 46. As is shown in detail in FIG. 4, the internal step portion 20 of the inner peripheral face of the body 12 is disposed just in front of the external step portion 46, and in this way, sliding of the first sleeve 44 toward the front is prevented.

As is shown in detail in FIG. 3, there is an insertion groove 48 that has a curved rectangular cross-section formed at a top portion and at a bottom portion of the inner peripheral face of the first sleeve 44, and the insertion groove 48 is disposed along the forward-rearward direction. The tumblers 40 that protruded out from the rotor 28 are inserted within the insertion groove 48, and in this way the first sleeve 44 is configured to be integrally rotatable with the rotor 28 through the tumblers 40.

There are T-shaped (in side view) slide bars 50 configuring the changeover unit fitted over a right side portion and a left side portion of a rear portion of the external periphery of the first sleeve 44. The slide bars 50 are not movable in the circumferential direction around the first sleeve 44, but are able to slide to the rear thereof. There are engagement portions 50A formed at the front ends of the slide bars 50, and the engagement portions 50A have a narrow width and are shaped as substantially rectangular plates, with all of the angled portions of the engagement portions 50A being rounded off. As is shown in detail in FIG. 4, the engagement portions 50A engage with (fit into) the engagement recesses 22 of the body 12, and by doing so, the rotation of the first sleeve 44 is restricted through the slide bars 50.

There is a substantially cylindrical second sleeve 52 disposed behind the first sleeve 44, and serving as an engaging member, and the rotor 28 is fitted within the second sleeve 52 so as to be rotatable. The slide bars 50 of the first sleeve 44 abut at the front face of the second sleeve 52, and the second sleeve 52 is able to slide to the rear. There are substantially rectangular in cross-section recessed engagement grooves 54 formed in the radial direction at a top portion and at a bottom portion of the front face of the second sleeve 52, and the stopper plate 34 of the rotor 28 is inserted and engaged at the engagement grooves 54. In so doing, the second sleeve 52 is integrally rotatable with the rotor 28 through the stopper plate 34.

A substantially cylindrical holder lever 56 serving as a retaining member is disposed behind the second sleeve 52, and a substantially circular ring plate front face plate 56A is provided at the front face of the holder lever 56. An internal portion (central portion) of the front face plate 56A is rotatably passed through by the small diameter portion 28A of the rotor 28, and thereby the forward movement of the holder lever 56 is stopped by the portion of the small diameter portion 28A of the rotor 28 that is just in front of the front face plate 56A. A resilient plate E-ring 58 is fitted as a pull-out prevention member at the small diameter portion 28A of the rotor 28, and in this way movement of the holder lever 56 in the rearward direction is stopped by the E-ring 58 at the front face plate 56A.

The second sleeve 52 is fitted to the front face plate 56A, and in doing so the holder lever 56 is made integrally rotatable with the second sleeve 52. There is a substantially rectangular plate stopper protrusion 60 integrally formed at a left side portion of the front face plate 56A, and the stopper protrusion 60 protrudes forward of the front face plate 56A.

Between the second sleeve 52 and the holder lever 56 is disposed a back spring 62, serving as a biasing component, and the back spring 62 is in the form of a compression spring, with the internal portion thereof passed through by the rotor 28. The back spring 62 is sandwiched between the second sleeve 52 and the 56, and the back spring 62 biases the second sleeve 52 in the forward direction whilst biasing the holder lever 56 in the rearward direction. One end of the back spring 62 is anchored to the stopper protrusion 60 of the holder lever 56 and the other end of the back spring 62 is anchored to the body 12, the back spring 62 biasing the holder lever 56 toward the initial rotational position.

There is a lever 64 provided as an object to be operated to the rear of the holder lever 56, and a resilient circular axel shaped pin spring 66 serving as a resilient assembly member passes through the lever 64. The pin spring 66 is engaged with a rear side portion of the front face plate 56A of the holder lever 56, and thereby the lever 64 is assembled to the holder lever 56 by the pin spring 66, and the lever 64 is made integrally rotatable to the holder lever 56 through the pin spring 66. The small diameter portion 28A of the rotor 28 is disposed in front of the lever 64, and there is a resilient cylindrical cushion 68 retained, sandwiched, between the lever 64 and the small diameter portion 28A.

The lever 64 is connected to a non illustrated operating mechanism (for example a door lock mechanism), and the operating mechanism is operated by the rotation of the 64 (for example a door lock mechanism undertakes a locking operation or an unlocking operation).

Next, the operation of the exemplary embodiment of the present invention will be explained.

In the above configuration of the key cylinder 10, when the authentic key is inserted from the front into the key insertion hole 30 of the rotor 28 through the key insertion hole 26 of the block 24, the tumblers 40 are slid in the rotor 28 by the key groove of the authentic key, overcoming the biasing force of the coil springs 42, and the insertion of the tumblers 40 into the insertion groove 48 of the first sleeve 44 is eliminated. Due to this, if the authentic key is operated by rotation, rotating the block 24 and the rotor 28, the first sleeve 44 does not rotate, but the second sleeve 52 is rotated (operated) via the stopper plate 34 of the rotor 28, overcoming the biasing force of the back spring 62, and by the holder lever 56 and the lever 64 being rotated, the operation mechanism is operated. When the operating rotational force of the authentic key is released, the block 24, the rotor 28, the second sleeve 52, the holder lever 56 and the lever 64 are rotated back to their initial rotational positions, by the biasing force of the back spring 62.

On the other hand, when an insertion member other than the authentic key (such as an incorrect key) is inserted from the front into the key insertion hole 30 of the rotor 28 through the key insertion hole 26 of the block 24, the tumblers 40 are not slid in the rotor 28, and the intruding of the tumblers 40 into the insertion groove 48 of the first sleeve 44 is maintained. Due to this, when the insertion member is operated by rotation, rotating the block 24 and the rotor 28, the first sleeve 44 is rotated via the tumblers 40, the engagement of the engagement portions 50A of the slide bars 50 of the first sleeve 44 in the engagement recesses 22 of the inner peripheral of the body 12 is released due to a cam-like action between the rounded surfaces of the engagement portions 50A and the rounded surfaces of the recesses 22. This cam-like action (indicated in phantom in FIG. 4) causes the slide bars 50 to slide to the rear. In this way, the second sleeve 52 is slid to the rear by the slide bars 50 overcoming the biasing force of the back spring 62. Due to the withdrawal of the stopper plate 34 of the rotor 28 from the engagement grooves 54 of the second sleeve 52, the second sleeve 52, the holder lever 56, and the lever 64 are not rotated even though the rotor 28 is rotated. Consequently, the operating mechanism is not operated.

Here, the stopper plate 34 of the rotor 28 intruding into the latch groove 16 of the body 12 not only has the function of being able to stop movement to the front and to the rear of the rotor 28, but also the stopper plate 34, inserted into the engagement grooves 54 of the second sleeve 52, has the function of making the second sleeve 52 rotatable by the rotation of the rotor 28. Therefore the construction may be simplified.

Also, when the key cylinder 10 is assembled, in the state in which the block 24 and the rotor 28 (including the tumblers 40 and the coil springs 42) and the first sleeve 44 (including the slide bars 50) are inserted from the back, the stopper plate 34 is pressed into the imposing hole 32 of the rotor 28 via the insertion hole 18 of the body 12. Furthermore, the second sleeve 52, holder lever 56 and the back spring 62 are assembled from the back of the rotor 28, and the E-ring 58 is fitted over the small diameter portion 28A of the rotor 28, and also the back spring 62 is anchored to the body 12 and the stopper protrusion 60 of the holder lever 56. Furthermore, the lever 64 is assembled with the pin spring 66 from the back of the holder lever 56, and also the cushion 68 is sandwiched and retained between the small diameter portion 28A of the rotor 28 and the lever 64.

By so doing, the block 24, rotor 28 and first sleeve 44 are inserted into the body 12 from the back (vehicle interior side), and assembled. Due to this, the front face portion 12A that stops movement of the block 24, rotor 28 and first sleeve 44 in the forward direction (vehicle exterior direction) may be provided integral to the body 12, and it may be made difficult to remove the block 24, rotor 28 and first sleeve 44 from the front (vehicle exterior side).

Furthermore, even when an impact force acts from the front (vehicle exterior side) towards the rear (vehicle interior side) on the block 24, rotor 28 and first sleeve 44 in the body 12, the stopper plate 34 of the rotor 28 is latched in the latch groove 16, and so the movement of the block 24, rotor 28 and first sleeve 44 in the rearward direction may be restricted.

By the above, it may be made difficult to illegitimately rotate the second sleeve 52, holder lever 56 and lever 64, and may be made difficult to illegitimately operate the operation mechanism.

In the exemplary embodiment the stopper plate 34 of the rotor 28 is configured so as to be able to stop movement to the front and to the rear of the rotor 28, however, the stopper plate 34 may be configured so to stop at least one of the movement to the front or the movement to the rear of the rotor 28.

Furthermore, in the exemplary embodiment the forward direction is designated as the facing towards the vehicle exterior direction and the front surface of the key cylinder 10 is configured to be exposed to the exterior of the vehicle, however, the forward direction of the key cylinder 10 may be faced towards the vehicle cabin (including the trunk) interior direction, and the front face of the key cylinder 10 may be configured to be exposed to the vehicle interior.

What is claimed is:

1. A key cylinder comprising:

a rotor, rotating by a key being inserted therein at one end and rotationally operated;

an accommodating member, accommodating the rotor;

a latching member, provided at the rotor, stopping movement of the rotor within the accommodating member in at least one of a direction of insertion of the key, or a direction of extraction of the key;

an engaging member disposed at an opposite end of said rotor and having a portion for receiving said latching member such that when an authentic key is inserted into the rotor and the rotor has been rotated, said portion engages with the latching member and said engaging member is operated by rotation of the rotor, and at least one slide bar for moving said engaging member in a key-insertion direction when an authentic key is not inserted into the rotor and the rotor has been rotated such that said portion disengages from the latching member and said engaging member is not operated by the rotation of the rotor.

2. A key cylinder according to claim 1, wherein the rotor may be assembled by inserting into the accommodating member in the key extraction direction.

3. A key cylinder according to claim 1, wherein a rear portion of the rotor has a substantially rectangular in cross-section imposing hole pierced therethrough in the up-down direction, and a substantially rectangular plate-shaped stopper plate is inserted as the latching member from one end of the imposing hole at the accommodating member, and the stopper plate is interposed in the rotor.

4. A key cylinder according to claim 3, wherein at one end portion of the stopper plate there is a through hole pierced therethrough, and the through hole is open from one end of the stopper plate.

5. A key cylinder according to claim 4, wherein there is a latch groove formed in the accommodating member, and one end of the stopper plate protrudes from the rotor in the up-down direction, and is inserted in the latch groove.

6. A key cylinder according to claim 1, wherein a substantially cylindrical first sleeve is rotatably accommodated in the accommodation member, and a portion of the rotor is rotatably fitted into the first sleeve.

7. A key cylinder according to claim 6, wherein said at least one slide bar includes a pair of substantially T-shaped slide bars which are fitted over a right side portion and a left side portion of a rear portion of the external periphery of the first sleeve, and the slide bars are not movable in the circumferential direction around the first sleeve, but are able to slide to the rear.

8. A key cylinder according to claim 7, wherein there is a substantially cylindrical second sleeve, serving as the engaging member, disposed behind the first sleeve, and the rotor is fitted within the second sleeve so as to be rotatable.

9. A key cylinder according to claim 8, wherein the slide bars of the first sleeve abut at the front face of the second sleeve, and the second sleeve is able to slide to the rear.

10. A key cylinder according to claim 9, wherein there are substantially rectangular in cross-section recessed engagement grooves formed in the radial direction at a top portion and at a bottom portion of the front face of the second sleeve, and the stopper plate of the rotor is inserted and engaged at the engagement grooves when the stopper plate is positioned to engage said second sleeve.

* * * * *